US009388774B2

(12) United States Patent
Zhelyaskov et al.

(10) Patent No.: US 9,388,774 B2
(45) **Date of Patent: *Jul. 12, 2016**

(54) PRECISION PURGE VALVE SYSTEM WITH PRESSURE ASSISTANCE

(71) Applicant: Discovery Technology International, Inc., Sarasota, FL (US)

(72) Inventors: Valentin Zhelyaskov, Sarasota, FL (US); Mark Oudshoorn, Parrish, FL (US); Serhiy Petrenko, Kiev (UA)

(73) Assignee: Discovery Technology International, Inc., Sarasota, FL (US)

( * ) Notice: Subject to any disclaimer, the term of this patent is extended or adjusted under 35 U.S.C. 154(b) by 211 days.

This patent is subject to a terminal disclaimer.

(21) Appl. No.: 14/194,104

(22) Filed: Feb. 28, 2014

(65) Prior Publication Data

US 2014/0245997 A1 Sep. 4, 2014

Related U.S. Application Data

(60) Provisional application No. 61/771,162, filed on Mar. 1, 2013, provisional application No. 61/771,219, filed on Mar. 1, 2013, provisional application No. 61/791,463, filed on Mar. 15, 2013.

(51) Int. Cl.
*F02M 25/08* (2006.01)

(52) U.S. Cl.
CPC ..... *F02M 25/0836* (2013.01); *F02M 25/08* (2013.01); *F02M 25/089* (2013.01); *F02M 25/0872* (2013.01)

(58) Field of Classification Search
CPC ..... F02M 25/08; F02M 25/0818; F02M 25/0836; F02M 25/0872; F02M 25/089
USPC ..... 123/516, 518, 519, 520; 251/129.06, 251/284, 318, 326, 331; 310/311, 321, 310/323.01, 323.02, 328, 357
See application file for complete search history.

(56) References Cited

U.S. PATENT DOCUMENTS 3,389,554 A * 6/1968 Wolf ..... F02B 37/10 60/608
4,059,081 A 11/1977 Kayanuma
(Continued)

FOREIGN PATENT DOCUMENTS

JP 04-105959 U 9/1992
JP 2002-349364 A 12/2002
JP 2007278094 A * 10/2007 ..... F02M 25/08

OTHER PUBLICATIONS

Notification of Transmittal, the International Search Report and the Written Opinion of the International Searching Authority, dated Jun. 11, 2014, from the corresponding International Application No. PCT/US2014/019620.

*Primary Examiner* — Stephen K Cronin
*Assistant Examiner* — Kevin R Steckbauer
(74) *Attorney, Agent, or Firm* — Young Basile Hanlon & MacFarlane, P.C.

(57) ABSTRACT

A pressure-assisted precision purge valve system is provided in an evaporative emission control system that provides flow of fuel vapor-air mixture from a fuel tank to an intake manifold. The pressure-assisted precision purge valve system comprises an absorbent canister through which the fuel vapor-air mixture flows, a purge valve configured to regulate flow of the fuel vapor-air mixture to the intake manifold and a fuel vapor pump configured to provide a forced flow to the purge valve dependent on a system differential pressure. The output of the purge valve can be connected to an upstream injection point and/or a downstream injection point of a forced induction device.

19 Claims, 6 Drawing Sheets

(56) References Cited

U.S. PATENT DOCUMENTS

| | | | | |
|---|---|---|---|---|
| 4,127,097 | A | 11/1978 | Takimoto | |
| 4,153,025 | A | 5/1979 | Thornburgh | |
| 4,308,841 | A | 1/1982 | Kingsley | |
| 4,326,489 | A | 4/1982 | Heitert | |
| 4,527,532 | A | 7/1985 | Kasai et al. | |
| 4,628,887 | A | 12/1986 | Mitchell et al. | |
| 4,664,087 | A | 5/1987 | Hamburg | |
| 4,700,683 | A | 10/1987 | Uranishi et al. | |
| 4,944,276 | A | 7/1990 | House et al. | |
| 5,226,401 | A | 7/1993 | Clarke et al. | |
| 5,269,278 | A * | 12/1993 | Heinemann | F02M 25/0836 123/520 |
| 5,918,580 | A * | 7/1999 | Hennrich | F02M 25/089 123/516 |
| 6,983,894 | B2 * | 1/2006 | Everingham | F02M 25/0836 123/520 |
| 7,228,851 | B2 | 6/2007 | Nakamura et al. | |
| 8,183,743 | B2 | 5/2012 | Petrenko et al. | |
| 8,299,684 | B2 | 10/2012 | Petrenko et al. | |
| 8,783,231 | B2 * | 7/2014 | Leone | F02M 25/08 123/336 |
| 8,979,065 | B2 * | 3/2015 | Zhelyaskov | F16K 31/004 251/129.06 |
| 2012/0247432 | A1 | 10/2012 | Cardno | |

* cited by examiner

PRECISION PURGE VALVE SYSTEM WITH PRESSURE ASSISTANCE

CROSS REFERENCE TO RELATED APPLICATION

The present application claims priority to U.S. Provisional Patent Application Nos. 61/771,219 filed on Mar. 1, 2013, 61/791,463 filed on Mar. 15, 2013, and 61/771,162, filed on Mar. 1, 2013, each incorporated herein in its entirety.

TECHNICAL FIELD

The embodiments herein relate to precision purge valve systems, and in particular precision purge valve systems as part of on-board evaporative emission control systems (EVAP).

BACKGROUND

In general, an on-board evaporative emission control system for an automotive vehicle comprises a vapor accumulating canister which serves as a collector of fuel vapors from the headspace of the fuel tank, and a purge valve which discharges on demand the fuel vapor-air mixture from the canister into an intake manifold of the engine in a controlled manner. The purge valve comprises an actuator, generally a solenoid, which acts upon a valve, generally of diaphragm or poppet type. The actuator is controlled by using a pulse-width modulation or other methods in order to regulate the flow of the fuel vapor-air mixture through the valve in a proportional matter.

These solenoid systems gain proportional flow by turning the valve on/off at low frequencies, creating an undesirable noise and providing rudimentary flow control. Some systems use a piezoelectric actuator. One such system is a piezoelectric actuator with a hydraulic amplifier as a substitute to the solenoid actuator, used to decrease the response time of the purge valve. A hydraulic system is used as a mechanical amplifier in order to increase the limited travel distance of the piezoelectric actuator.

Despite some response time improvement, this system introduces additional complexity due to the hydraulic system, which potentially decreases the reliability of the valve. With maximum open purge valve the flow is determined by the differential pressure between the input pressure (generally atmospheric pressure in the canister) and output pressure (the vacuum created in the intake manifold). While the input pressure does not change substantially, the differential pressure changes as the vacuum created in the intake manifold changes. As a result, the current state of the art EVAP systems have some substantial disadvantages. In a given purge valve the flow is determined primarily by the vacuum in the intake manifold. This limits the ability of the EVAP systems to always respond adequately to the needs of the engine. Hence the system does not control optimally in situations where the vacuum in the intake manifold is low and high flow is still desired, e.g. low RPM or turbo-charged engines.

Gas (air) pumps have been used as part of EVAP systems. In one application a gas pump, internally integrated with a canister, has been used to introduce atmospheric air into the canister to facilitate the flushing of the fuel vapors from the canister. In another application, a gas pump has been used as an actuator for the purge valve. No such system actively draws gas vapors and controls them from the gas tank to meet low or no vacuum situations.

Additional complications related to the use of the conventional purge valve are associated with its use in EVAP systems of engines with boosted power, which use superchargers or turbochargers (forced induction devices). The output of the purge valve is connected to the intake manifold, which in this particular case is the output of the supercharger. In this way, the output of the purge valve (injection point) is exposed to the output high pressure of the supercharger. In conventional purge valves, this decreases substantially the differential pressure between the input and output of the purge valve and either decreases or makes impossible the flow of vapors through the valve, limiting the ability to introduce the vapors when desired. In order to circumvent this problem, an evaporative emission purging system has been used, with an output connected to the intake air, upstream from a forced induction device. In this way, the purge valve uses the vacuum created by the supercharger at its air input to create a bigger differential pressure, which results in a bigger flow. To improvement this device, a venturi tube can be used, positioned in a restricted area upstream from the forced induction device to additionally decrease the pressure at the injection point and to additionally increase the flow through the purge valve. This valve with the venturi tube reduces the requirements on the air pump. Despite these changes described above, the flow in the purge valve depends heavily on the vacuum created at the injection point, i.e. it depends on the engine working status, e.g. RPM.

BRIEF SUMMARY

The embodiments herein relate to precision purge valve systems, and in particular precision purge valve systems as part of on-board evaporative emission control systems (EVAP), which includes an automated purge valve and gas pump to assist the flow of the fuel vapor-air mixture. The embodiment describes as well the various configurations of utilizing the described purge valve system with a forced induction device, which is used to increase the flow of air into the engine manifold and boost the engine power.

The embodiments disclosed herein address the above disadvantages. According to one aspect, a new type of purge valve system as part of an EVAP system is proposed based on a combination of a controlled automated purge valve and a gas pump. While the final resolution control of the purge system is provided by the resolution of the actuator, the gas pump serves the purpose of increasing the flow depending on the differential pressure between the canister and the intake manifold of the engine and the required flow for optimal performance of the engine. The pump is activated when the differential pressure is low due to either low vacuum or additional positive pressure in the intake manifold due to supercharging.

On embodiment of a pressure-assisted precision purge valve system is provided in an evaporative emission control system that provides flow of fuel vapor-air mixture from a fuel tank to an intake manifold. The pressure-assisted precision purge valve system comprises an absorbent canister through which the fuel vapor-air mixture flows, a purge valve configured to regulate flow of the fuel vapor-air mixture to the intake manifold and a fuel vapor pump configured to provide a forced flow to the purge valve dependent on a system differential pressure. The output of the purge valve can be connected to an upstream injection point and/or a downstream injection point of a forced induction device.

These and other aspects of the present disclosure are disclosed in the following detailed description of the embodiments, the appended claims and the accompanying figures.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
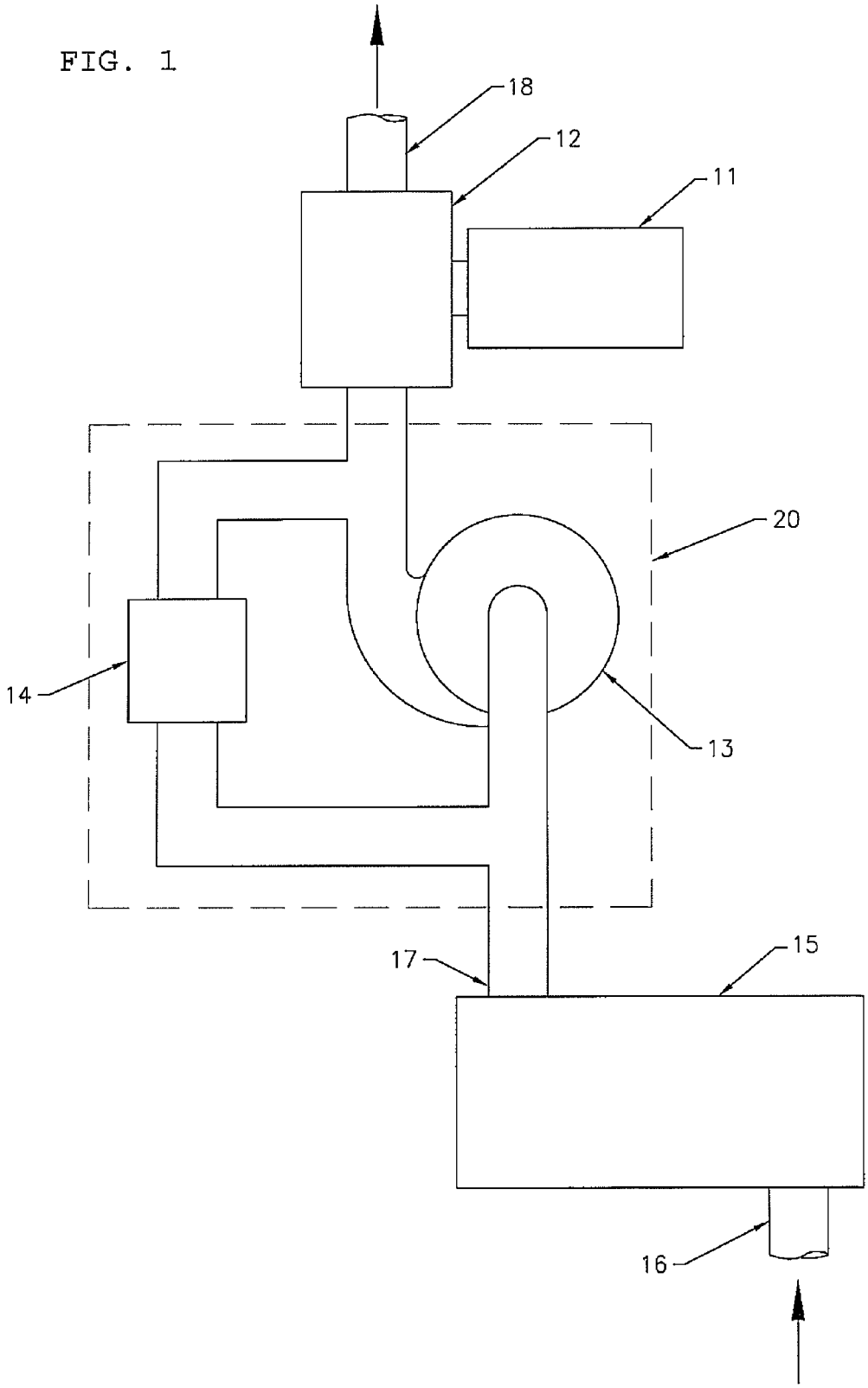
FIG. 1 is a simplified schematic of purge valve system based on automated purge valve and gas pump in first implementation with a canister.

The present invention is described with reference to the attached figures, wherein like reference numerals are used throughout the figures to designate similar or equivalent elements. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

A purge valve system for an on-board evaporative emission control system is illustrated in FIG. 1. Fuel vapor from a fuel tank (not shown) flows into a canister 15 through input 16. The canister 15 accommodates an adsorbent such as activated charcoal for adsorbing the fuel vapor. The flow output 17 of the canister 15 provides flow to a fuel vapor pump/check assembly 20. The fuel vapor pump/check assembly 20 comprises a fuel vapor pump 13 and a check valve 14. The fuel vapor pump 13 can be of a centrifugal type. The check valve 14 provides redirection of the flow depending on the fuel vapor pump operation.

The fuel vapor pump/check assembly 20 outputs the fuel flow to purge valve 12, which regulates the flow to the intake manifold through purge valve output 18. As non-limiting examples, the valve 12 can be a poppet, diaphragm, gate or slide valve if a linear actuator is used or a ball, butterfly or disc valve if a rotary actuator is used. A piezoelectric motor 11 is used to operate the purge valve 12, the piezoelectric motor providing a higher resolution and more precise control of the fuel flow.

When the vacuum in the intake manifold on the output of the purge valve 12 is sufficient to provide the required flow through the purge valve 12, the flow of the fuel vapor-air mixture is directed through the path of check valve 14. In other words, when the differential pressure between the canister 15 and the intake manifold of the engine is sufficient, the flow of the fuel vapor-air mixture is directed through the path of check valve 14. The purge valve 12 controls the flow rate of the fuel vapor-air mixture to the intake manifold as described in more detail below.

If at any moment the differential pressure drops, such that the provided flow through the purge valve 12 is insufficient (i.e., decreased vacuum/increased pressure in the intake manifold), then the fuel vapor pump 13 is turned ON and the check valve 14 is closed. In both modes of operation, the purge valve 12 controls the flow of the fuel vapor-air mixture. The purge valve 12 controls the flow rate of the fuel vapor-air mixture to the intake manifold as described in more detail below.

The addition of the fuel vapor pump 13 alleviates problems associated when the purge valve flow is exclusively dependent on the vacuum/pressure in the intake manifold. As the pressure in the intake manifold increases, or the vacuum decreases, the fuel vapor pump 13 provides the additional pressure upstream of the intake manifold to increase the pressure differential sufficient to maintain flow through the purge valve 12 to the intake manifold. The purge valve in turn regulates the flow rate of the fuel vapor to the intake manifold.

Figure 2:
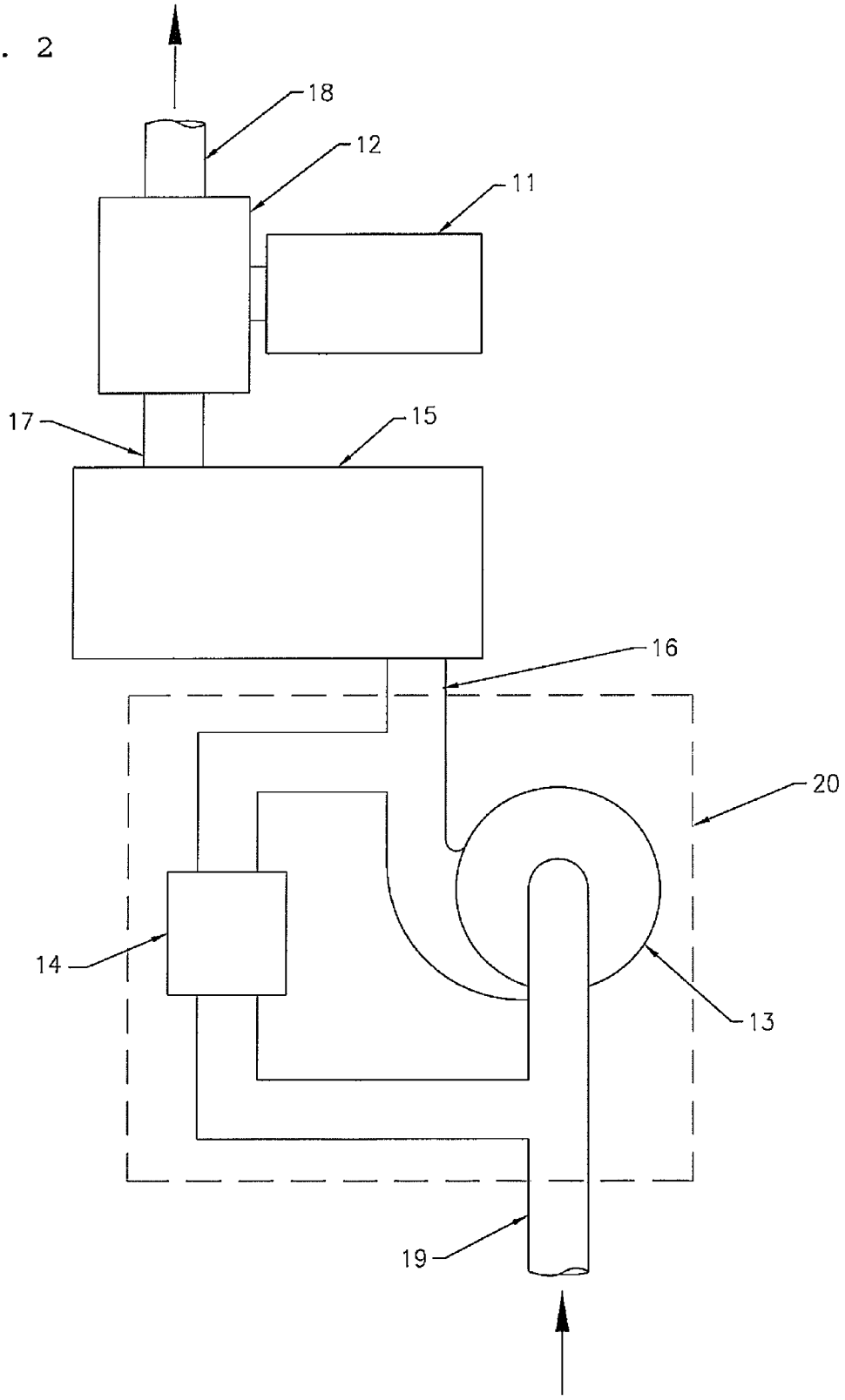
FIG. 2 is a simplified schematic of purge valve system based on automated purge valve and gas pump in second implementation with a canister.

In a second embodiment shown in FIG. 2, a purge valve system for an on-board evaporative emission control system is similar to the first embodiment, with the difference being that the canister is located between the output 16 of the vapor pump/check assembly 20 and the purge valve 12.

The purge control valve 12 controls the flow of the fuel vapor-air mixture received from either the check valve 14 or the fuel vapor pump 13 and to the intake manifold or other location as described later herein. The purge control valve 12 can accurately adjust flow rates to a multitude of values due to nano-scaled linear movement, providing multiple intermediate valve positions throughout the travel range of the valve, by using a single excitation frequency. The purge control valve 12 operates with the piezoelectric motor 11, which is disclosed in more detail with reference to FIG. 3. The piezoelectric motor 11 uses one source of alternating voltage at a frequency to excite two modes simultaneously without the need for a special configuration of the excitation electrodes. Thus, a single excitation source combination resonator is provided in the various control valve embodiments. This single source is different from conventional means of providing nano-elliptical motion. Conventionally, such a system of excitation would require excitation of a piezoelectric resonator using two different sources of alternating voltage with equal frequencies, but shifted in phase relative to each other by approximately 90° and a special arrangement of electrodes. Such a two-generator excitation system is typically complex and requires that high stability of the phase relationship be maintained, as any unbalance directly affects the basic performance of the motor. This generally imposes additional requirements on the control of the excitation system and increases overall costs.

Figure 3:
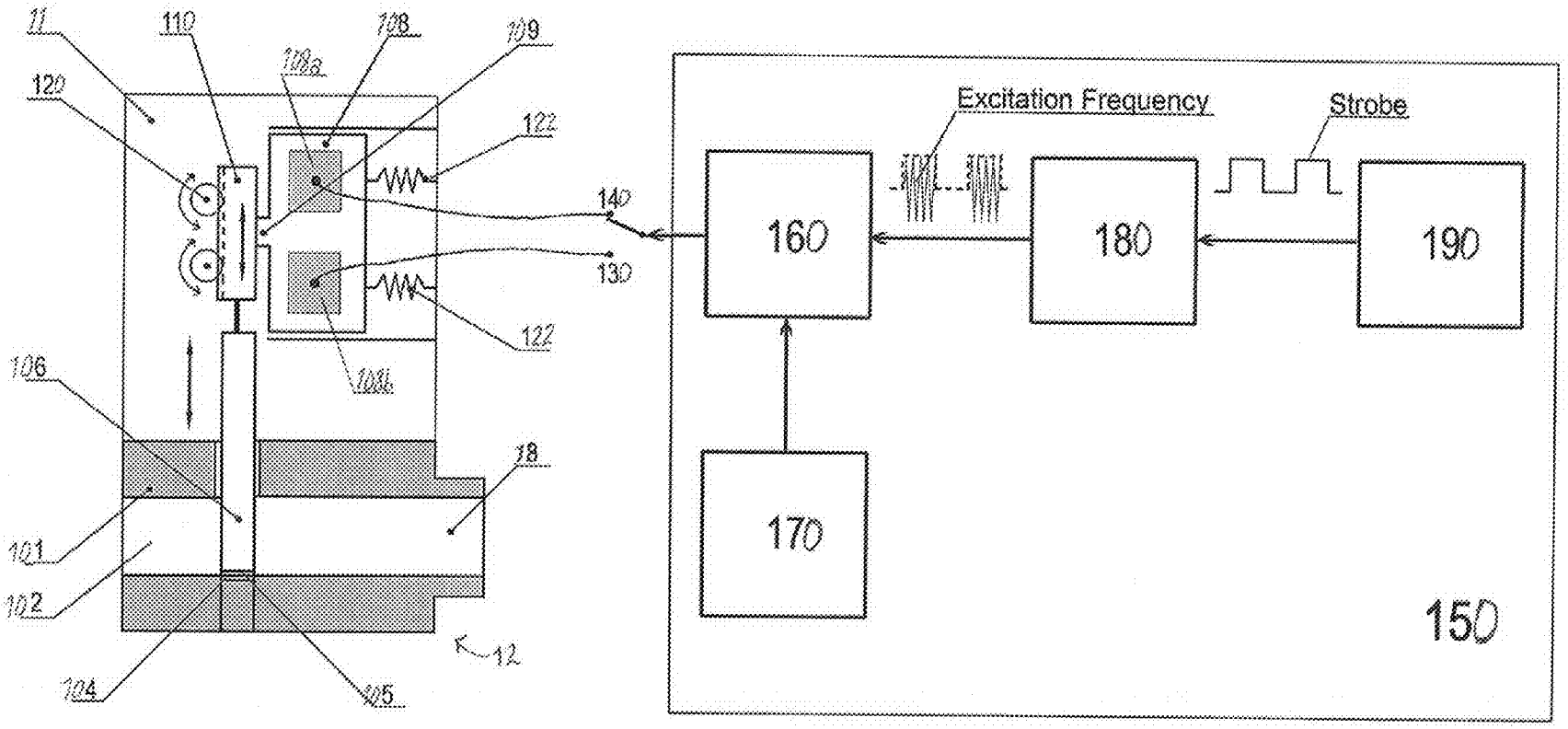
FIG. 3 is a simplified schematic of the purge valve and piezoelectric motor of the systems disclosed herein.

The purge control valve 12 and piezoelectric motor 11 as shown in FIG. 3 are described in detail in U.S. patent application Ser. No. 14/193,122, which is incorporated herein by reference in its entirety, with the motor more fully described in U.S. Pat. No. 8,299,684, also incorporated herein by reference in its entirety. However, one embodiment will be described herein in detail. The purge control valve 12 and piezoelectric motor 11 have a body 101 with input passage 102 configured to connect to either the output 17 of the container 15 or the output of the fuel vapor pump/check assembly 20, and output passage 18 which is configured to connect to either the intake manifold or another device. A flow control member 106 is movable across the input and output passages 102, 18, defining the change from the input passage 102 to the output passage 18. A valve seat 104 is positioned along the input and output passages 102, 18 to receive a distal end 105 of the flow control member 106 when the valve is in a closed position. In this way, the relative position of flow control member 106 regulates the quantity of fluid passing through purge valve 12.

The flow control member 106 is connected to the piezoelectric motor 11. The piezoelectric motor 11 operates using a piezoelectric resonator 108 and a working element 110. The piezoelectric resonator 108 can be formed of any suitable piezoelectric material. For example, the piezoelectric resonator 8 can be formed of barium titanate, or lead-zirconate-titanate (PZT). One of the working element 110 and the piezoelectric resonator 108 is configured to move relative to the other, with the unmoving one being connected to the body 1. In FIG. 3, the working element 110 is supported by a support structure 120 comprising bearing rails as a non-limiting example. In FIG. 3, the working element 110 is configured to move linearly along the bearing rails, translating its movement to the flow control member 106, thus regulating the flow through the valve. The working element 110 can be made from a solid material, with steel being a non-limiting example.

The linear movement of the working element 110 results from the piezoelectric resonator 108, which can be a fixed flat resonator and can work on the principle of combination of excited standing acoustic longitudinal waves and contact with the working element 110. The piezoelectric resonator 108 frictionally contacts the working element 110 at a contact site 109. The frictional contact is assisted by a spring 122, configured to press the piezoelectric resonator 108 against the working element 110 at the contact site 109. As illustrated, the spring 122 is positioned between a wall of the piezoelectric resonator 108 and the body 101.

The purge valve 12 and piezoelectric motor 11 disclosed herein operate as follows. Excitation of the piezoelectric resonator 108 causes motion of the contact site 109 along a nano-elliptical path. In general, the elliptical paths have amplitudes (i.e. dimensions of the minor and major axes) on the order of tens to hundreds of nanometers and are generally flat with respect to the direction of motion. That is, the major axis of the resulting elliptical paths is generally located in a direction parallel to the direction of motion.

In the various embodiments of the present invention, the nano-elliptical motion of the contact site 109 is formed by a superposition of two standing waves associated with orthogonal vibrational modes of the piezoelectric resonator 108 such that the points of maximum vibrational velocity correspond with the position of the contact site 109—that is, the points in the piezoelectric resonator 108 in which the standing waves of both of the orthogonal vibrational modes peak. The vibrational modes are excited by providing an excitation voltage via one of a pair of electrodes 108*a*, 108*b* associated with a lead 130, 140. That is, to provide nano-elliptical paths in a first direction and that provide force to the working element 110 in a first direction to one of open or close the valve, excitation voltages are provided at electrode 108*a*. The electrode 8*a* is fabricated from a conductive material, such as silver. To provide similar nano-elliptical paths, but that provide force to the working element 110 in an opposite direction to the other of open or close the valve, excitation voltages are provided at electrode 108*b*.

As shown in FIG. 3, leads 130 and 140 are connected to a control system 150. The control system 150 includes a pulse amplifier 160, which is connected to a suitable external power supply 170. A high frequency generator 180 produces the excitation resonant frequency for the piezoelectric resonator 108, and a modulating device 190 determines the duration and the repetition rate of the group of high frequency pulses, which is connected to the input of the high frequency generator 180.

A high frequency signal corresponding to the excitation resonance frequency of the piezoelectric resonator 108 is generated by high frequency generator 180. The high frequency signal is amplified by the pulse amplifier 160 and the signal is applied to a lead 130, 140 of the piezoelectric resonator 108. The piezoelectric resonator 108 is configured with a specific geometry and transverse polarization that causes excitation of two mutually orthogonal longitudinal waves. The superposition of the two mutually orthogonal longitudinal waves creates nano-elliptical mechanical movement of the piezoelectric resonator 108 at the contact site 109. Since the contact site 109 is frictionally conjugated to the working element 110, the working element 110 moves linearly, consequently moving the flow control member 106 linearly.

In order to create micro/nano linear movements of the flow control member 106, pulses are generated at the output of the modulating device 190 the duration of which determines the linear step of the motor. Hence, high linear resolution is achieved by using the piezoelectric motor 11 in stepping mode, which provides high resolution of regulation of the flow.

Although the motor 11 described herein generates linear movement via elliptical movement of the contact site 109, the elliptical movement described herein is provided by means of example only. Movement of the contact site 109 along line can also be utilized to produce linear movement of the flow control member 106. The purge valve 12 disclosed can increase the range of movement of the flow control element of the valve to 10 mm or more, and thus greatly increase the range of adjustment of the flow. The minimum step for movement of the flow control member in this system can range from 10 nm to 100 nm, which substantially increases the resolution of the valve. This purge valve 12 has essentially no drift and does not consume any power while the stem is not moving.

For automobiles having superchargers or turbochargers, herein referred to as forced induction devices, the output of the forced induction device is into the intake manifold. This output from a forced induction device increases the pressure in the intake manifold, which in turn can create very low or no pressure differential between the intake input pressure and the intake manifold. In the embodiments herein, the output 18 of the purge valve 12 is relocated from the intake manifold.

Figure 4:
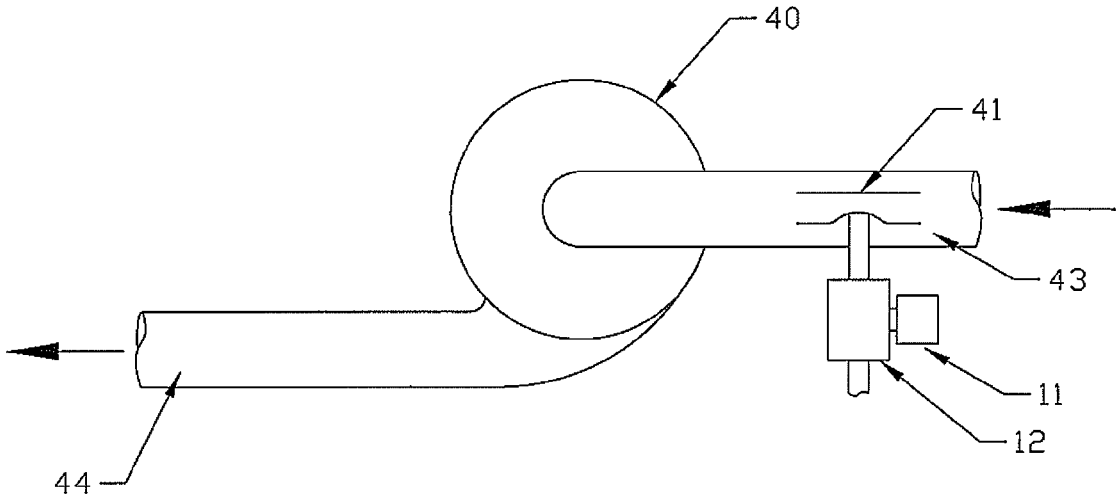
FIG. 4 is a simplified schematic of purge valve system in implementation with a forced induction device, based on automated purge valve and gas pump, with its output (injection point) connected to a venturi tube situated upstream of forced induction device.
Figure 5:
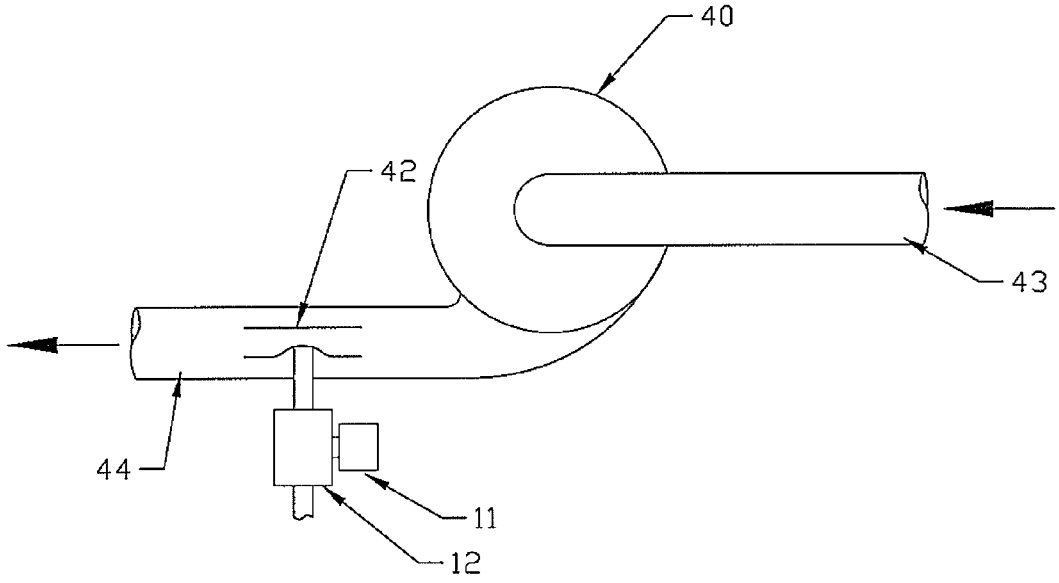
FIG. 5 is a simplified schematic of purge valve system in implementation with a forced induction device, based on automated purge valve and gas pump, with its output (injection point) connected to a venturi tube situated downstream of forced induction device.
Figure 6:
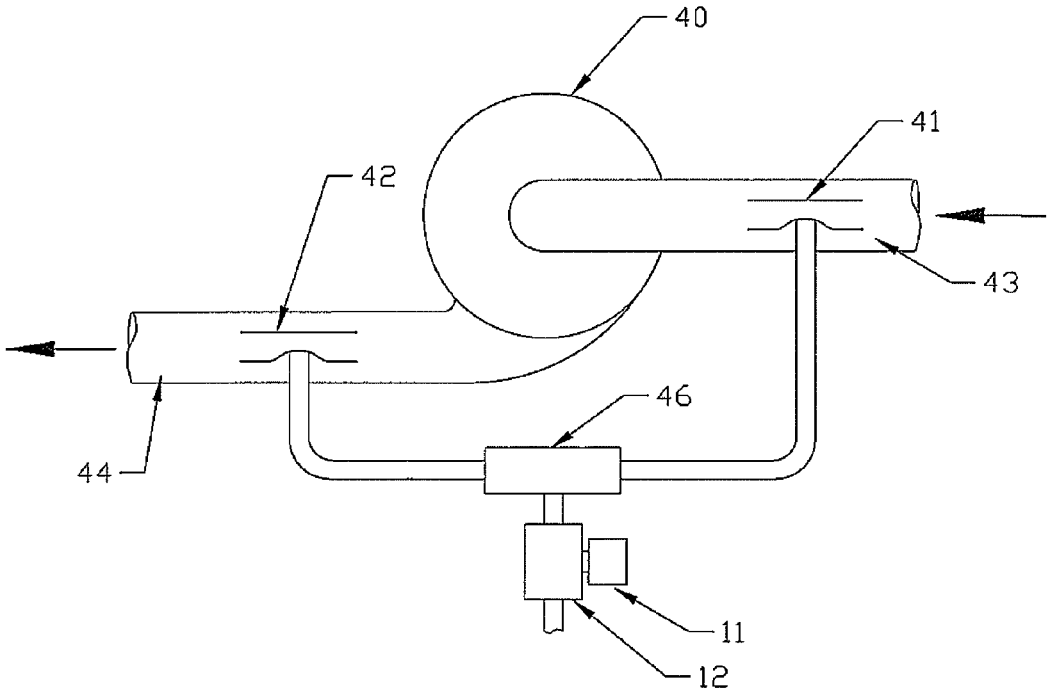
FIG. 6 is a simplified schematic of purge valve system in implementation with a forced induction device, based on automated purge valve and gas pump, with its output switchable alternatively, by using a valve, to injection points at venturi tubes situated downstream and upstream of forced induction device.

Referring to FIGS. 4-6, the output 18 of the purge valve 12 is connected to a forced induction device 40. The forced induction device 40 has an intake 43 positioned upstream of the forced induction unit 40 and a downstream output 44 connected to the intake manifold. In FIG. 4, a venture tube 41 is positioned in the intake 43 of the forced induction device 40. The output 18 of the disclosed purge valve system is connected to the venturi tube 41, which has a reduced pressure due to the Venturi effect. The differential pressure under which the purge valve system operates is determined from the intake pressure and the pressure at the outlet 18 of the purge valve 12, which, in this embodiment, is the reduced pressure at the venture tube 41 on the intake 43 of the forced induction device 40. By moving the outlet 18 of the purge valve 12 to the venture tube 41, the demand on the purge pump 13 is reduced as the pressure differential of the system is greater. This configuration provides decreased pressure at the output of the purge valve 12, while the incorporation of the fuel vapor pump 13 increases pressure at the input of the purge valve 12. The combination of both effects increases the flow capacity of the purge valve system and reduces fuel vapor pump 13 demands. In addition, this configuration makes the performance of the purge valve 12 less dependent on the vacuum at the input of the forced induction device and its performance characteristics, particularly its RPM.

In an alternative configuration shown in FIG. 5, the venturi tube 42 is located in the downstream output 44 of the forced induction device 40. The output 18 of the purge valve 12 feeds into this venture tube 42. In another alternative configuration shown in FIG. 6, two venturi tubes 41, 42 are placed correspondingly in the upstream intake 43 and the downstream output 44 from the forced induction device 40, and the output 18 of the purge valve 12 can be alternatively connected to either one of venturi tubes 41, 42 depending on the requirements of the engine by selector valve 46.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A pressure-assisted precision purge valve system in an evaporative emission control system providing flow of fuel vapor-air mixture from a fuel tank to an intake manifold, the pressure-assisted precision purge valve system comprising:

an absorbent canister through which the fuel vapor-air mixture flows;

a purge valve configured to regulate flow of the fuel vapor-air mixture to the intake manifold;

a fuel vapor pump configured to provide a forced flow to the purge valve dependent on a system differential pressure; and a piezoelectric linear motor, wherein the piezoelectric linear motor comprises:

a piezoelectric resonator in which two orthogonal vibrational modes across a length and a width of the piezoelectric resonator are excited, the piezoelectric resonator configured to connect to a control system;

a working element; and one or more contact sites providing frictional contact between the working element and the piezoelectric resonator, one of the working element and the piezoelectric resonator connected to the flow control member and configured to move relative to the other of the working element and the piezoelectric resonator due to the frictional contact, thereby moving a flow control member.

2. The pressure-assisted precision purge valve system according to claim 1, further comprising a check valve in parallel with the fuel vapor pump.

3. The pressure-assisted precision purge valve system according to claim 1, wherein an output of the absorbent canister is connected to an input of the gas vapor pump and an output of the gas vapor pump is connected to an input of the purge valve.

4. The pressure-assisted precision purge valve system according to claim 1, wherein the purge valve is a purge valve with linear displacement of a flow limiting element.

5. The pressure-assisted precision purge valve system according to claim 1, wherein the purge valve is a purge valve with rotary displacement of the flow limiting element.

6. The pressure-assisted precision purge valve system according to claim 1, wherein the purge valve is a spool valve.

7. The pressure-assisted precision purge valve system according to claim 1, wherein the piezoelectric resonator is fixedly mounted on a purge valve body and the working element is connected to the flow control member so that the working element is movable relative to the piezoelectric resonator.

8. The pressure-assisted precision purge valve system according to claim 1, wherein the working element is fixedly mounted to a purge valve body and the piezoelectric resonator is connected to the flow control member so that the piezoelectric resonator is movable relative to the working element.

9. The pressure-assisted precision purge valve system according to claim 1, wherein the piezoelectric resonator is configured as a flat piezoelectric element with transverse polarization.

10. The pressure-assisted precision purge valve system according to claim 1 further comprising:

a control system connected to the piezoelectric resonator, the control system comprising:

a pulse amplifier connected to an external power supply, the pulse amplifier having an input connected to an output of a high frequency generator which generates a frequency corresponding to excitation resonant frequencies of the piezoelectric resonator, and the pulse amplifier having an output connected to the piezoelectric resonator.

11. The pressure-assisted precision purge valve system according to claim 1, wherein an output of the fuel vapor pump is connected to an input of the absorbent canister and an output of the absorbent canister is connected to an input of the purge valve.

12. The pressure-assisted precision purge valve system according to claim 1, wherein an output of the purge valve is connected to an upstream intake of a forced induction device.

13. The pressure-assisted precision purge valve system according to claim 1, wherein an output of the purge valve is connected to a downstream output of a forced induction device.

14. The pressure-assisted precision purge valve system according to claim 1, wherein an output of the purge valve is switchable alternatively, by using a switching valve, between an upstream injection point and a downstream injection point of a forced induction device.

15. The pressure-assisted precision purge valve system according to claim 1, wherein an output of the purge valve is connected to a venturi tube situated upstream of a forced induction device.

16. The pressure-assisted precision purge valve system according to claim 1, wherein an output of the purge valve is connected to a venturi tube situated downstream of a forced induction device.

17. The pressure-assisted precision purge valve system according to claim 1, wherein an output of the purge valve is switchable alternatively, by using a switching valve, to injection points at venturi tubes situated downstream and upstream of a forced induction device.

18. The pressure-assisted precision purge valve system according to claim 12, wherein the purge valve includes an electromagnetic actuator.

19. The pressure-assisted precision purge valve system according to claim 12, wherein the purge valve includes a piezoelectric actuator.

* * * * *